US009545350B2

(12) United States Patent
Walters

(10) Patent No.: US 9,545,350 B2
(45) Date of Patent: Jan. 17, 2017

(54) SLIDING CHAIR FOR ASSISTING ENTERING AND EXITING A BATHTUB

(71) Applicant: Richard Walters, Temecula, CA (US)

(72) Inventor: Richard Walters, Temecula, CA (US)

( * ) Notice: Subject to any disclaimer, the term of this patent is extended or adjusted under 35 U.S.C. 154(b) by 365 days.

(21) Appl. No.: 14/327,386

(22) Filed: Jul. 9, 2014

(65) Prior Publication Data

US 2015/0013060 A1 Jan. 15, 2015

Related U.S. Application Data

(60) Provisional application No. 61/843,946, filed on Jul. 9, 2013.

(51) Int. Cl.

| | |
|---|---|
| ***A47K 3/12*** | (2006.01) |
| ***A47K 3/02*** | (2006.01) |
| ***A61G 7/10*** | (2006.01) |

(52) U.S. Cl.

CPC ..... *A61G 7/1003* (2013.01); *A61G 7/1017* (2013.01); *A61G 7/1019* (2013.01); *A61G 7/1059* (2013.01)

(58) Field of Classification Search

CPC .. A61G 7/1003; A61G 7/1017; A61G 7/1019; A61G 7/1059

USPC ..... 4/579, 561.1, 560.1, 562.1, 563.1, 564.1,4/565.1, 566.1

See application file for complete search history.

(56) References Cited

U.S. PATENT DOCUMENTS

| | | | | |
|---|---|---|---|---|
| 5,561,868 | A * | 10/1996 | Campbell | A47K 3/122 4/560.1 |
| 7,617,546 | B1 * | 11/2009 | Hill | E04H 4/14 4/496 |
| 2006/0236449 | A1 * | 10/2006 | Hammer | A61G 7/1003 4/560.1 |
| 2007/0083990 | A1 * | 4/2007 | Werschmidt | A61G 7/1003 4/560.1 |
| 2009/0025136 | A1 * | 1/2009 | Cheng | A47K 3/122 4/560.1 |

* cited by examiner

*Primary Examiner* — Christine Skubinna

(57) ABSTRACT

A sliding chair for assisting entering and exiting a bathtub provides assistance for handicapped or otherwise physically incapable persons in using a bathtub for bathing. A bathing chair is moved by a displacement mechanism from outside the bathtub to various positions within the bathtub. A chair support board supports the bathing chair in some positions, and slides along chair support rails into the bathtub.

20 Claims, 13 Drawing Sheets

SLIDING CHAIR FOR ASSISTING ENTERING AND EXITING A BATHTUB

The current application claims a priority to the U.S. Provisional Patent application Ser. No. 61/843,946 filed on Jul. 9, 2013.

FIELD OF THE INVENTION

The present invention relates generally to bathrooms. More particularly, the present invention relates to an apparatus for a bathtub chair that assists disabled persons with entering and exiting a bathtub.

BACKGROUND OF THE INVENTION

Bathing is the washing of the body with a fluid, usually water or an aqueous solution, or the immersion of the body in water. Bathing may be done for religious, ritual or therapeutic purposes or as a recreational activity, but is most often done for personal hygiene. It is typical or common for people to bathe every day, often at the same time such as first thing in the morning or before going to bed at night.

Bathing for personal hygiene is a means of achieving cleanliness by washing away dirt and bacteria, and is additionally a preventative measure to reduce the incidence and spread of disease. It also reduces bodily odors. Where bathing is for the purpose of personal hygiene, bathing in a bathtub or shower is the most common form of bathing in Western, and many Eastern, countries. Bathrooms usually have a tap, and a shower if it is a modern home, and a large water heating pot. Water is taken from the tap or water heating pot and used in conjunction with soap and often a rag or sponge to clean a person's body. Soap allows otherwise insoluble particles to become soluble in water and then be rinsed away. Soap is an excellent cleanser because of its ability to act as an emulsifying agent. An emulsifier is capable of dispersing one liquid into another, immiscible liquid, or one that does not form a homogeneous mixture. For example, water and oil are immiscible. The human body produces oil on its skin, which attracts dirt. Soap acts to suspend the oil and dirt in water in such a way that the oil and dirt can easily be washed away.

A physical disability is any disability which limits the physical function of one or more limbs. Other physical disabilities include impairments which limit other facets of daily living, such as respiratory disorders and epilepsy. Mental disabilities may also impair a person's physical abilities. Entering and exiting a shower or bathtub generally requires the ability to use one's legs to move the rest of the body into the shower or bathtub area, especially in the case of a bathtub as stepping over the edge of the tub is generally required to enter the tub area. This act can prove challenging to people with less than optimal function of their legs as a result of injury, infection, illness, obesity or another cause of disability. Disabled persons must often have a second person assist them into the tub when they wish to bathe.

It is therefore an object of the present invention to provide an apparatus for a chair that is able to bring a person from outside a bathtub to inside a bathtub without requiring strenuous physical activity or the help of a second person.

DETAIL DESCRIPTIONS OF THE INVENTION

Figure 1:
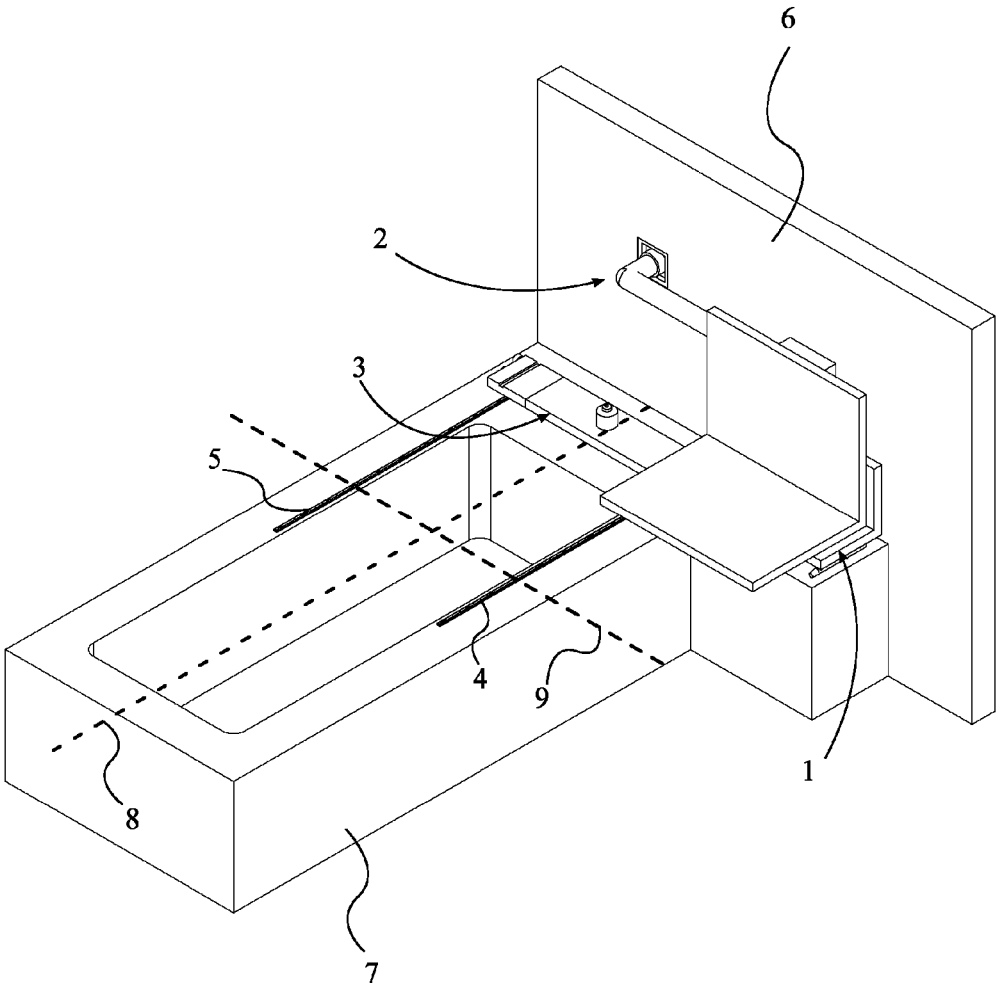
FIG. 1 is an elevated perspective view of the present invention in the first position.
Figure 2:
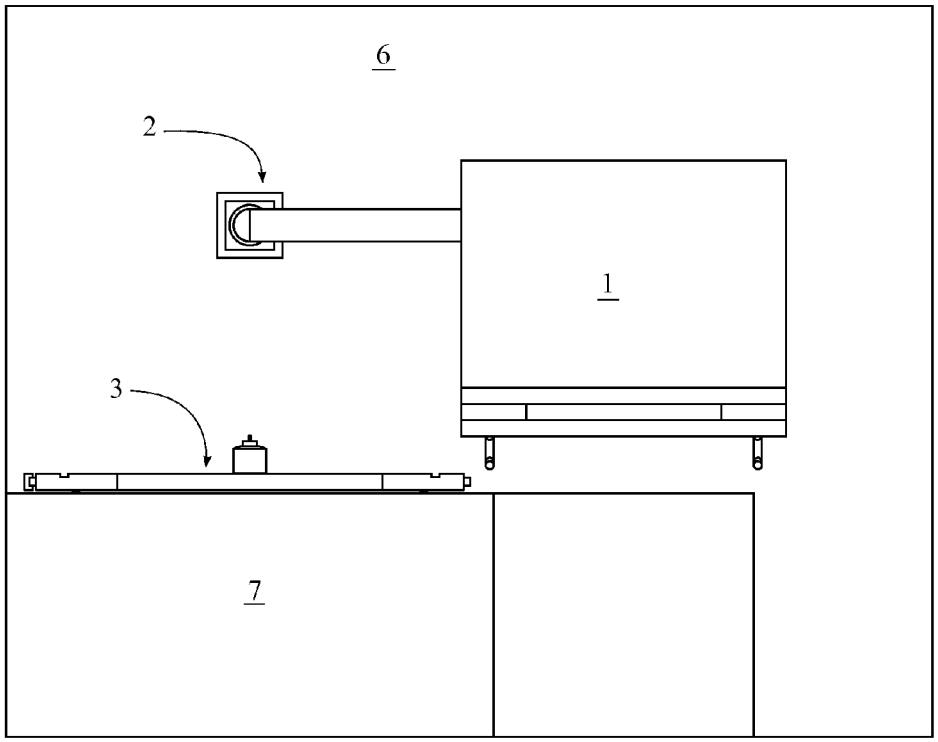
FIG. 2 is a front view of the present invention in the first position.
Figure 3:
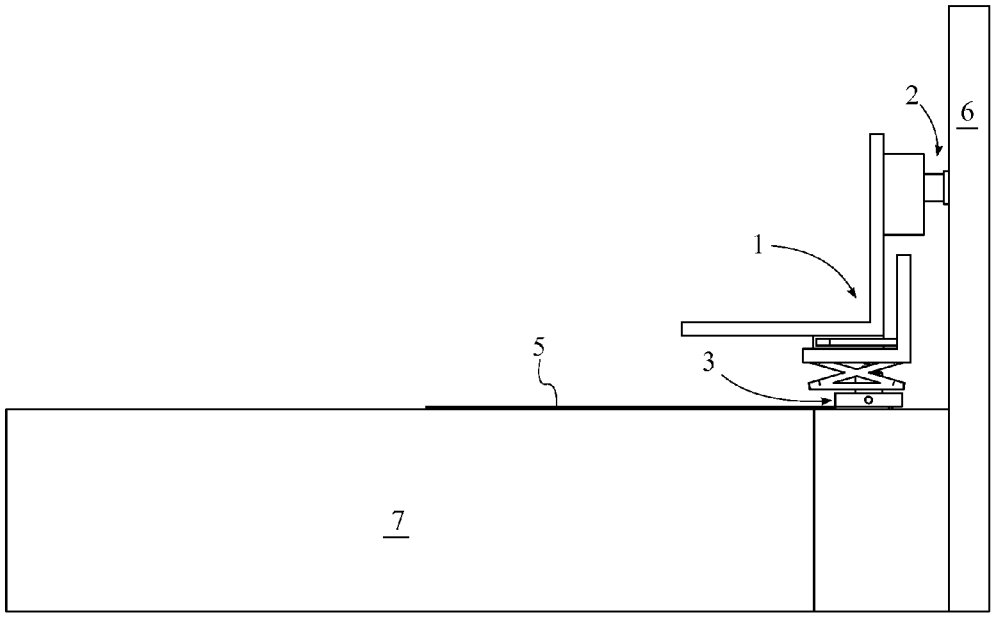
FIG. 3 is a right view of the present invention in the first position.
Figure 4:
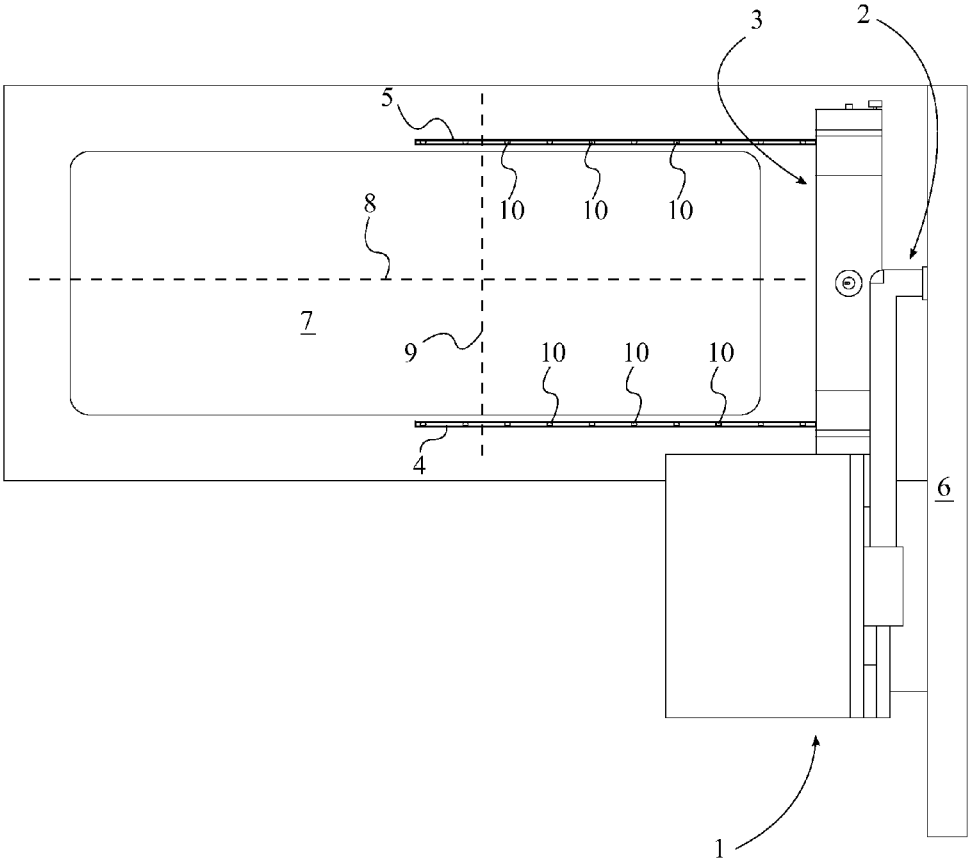
FIG. 4 is a top view of the present invention in the first position.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

Referring to FIGS. 1-4, the present invention is an apparatus for a sliding chair that can mechanically bring a person from outside a bathtub 7 to inside the bathtub 7 so that disabled persons may take a bath or shower without excess physical effort or assistance. The preferred embodiment of the present invention generally comprises a bathing chair 1, a chair displacement mechanism 2, a chair support board 3, a first chair support rail 4 and a second chair support rail 5. The chair displacement mechanism 2 is positioned adjacent to the bathtub 7. The bathing chair 1 is operatively connected to the chair displacement mechanism 2, wherein the chair displacement mechanism 2 is capable of displacing the bathing chair 1 along both a longitudinal direction 8 and a lateral direction 9 for the bathtub 7. The bathing chair 1 is removably connected atop the chair support board 3, and the chair support board 3 is slidably connected to the first chair support rail 4 and the second support rail, which are oriented along the longitudinal direction 8.

Figure 5:
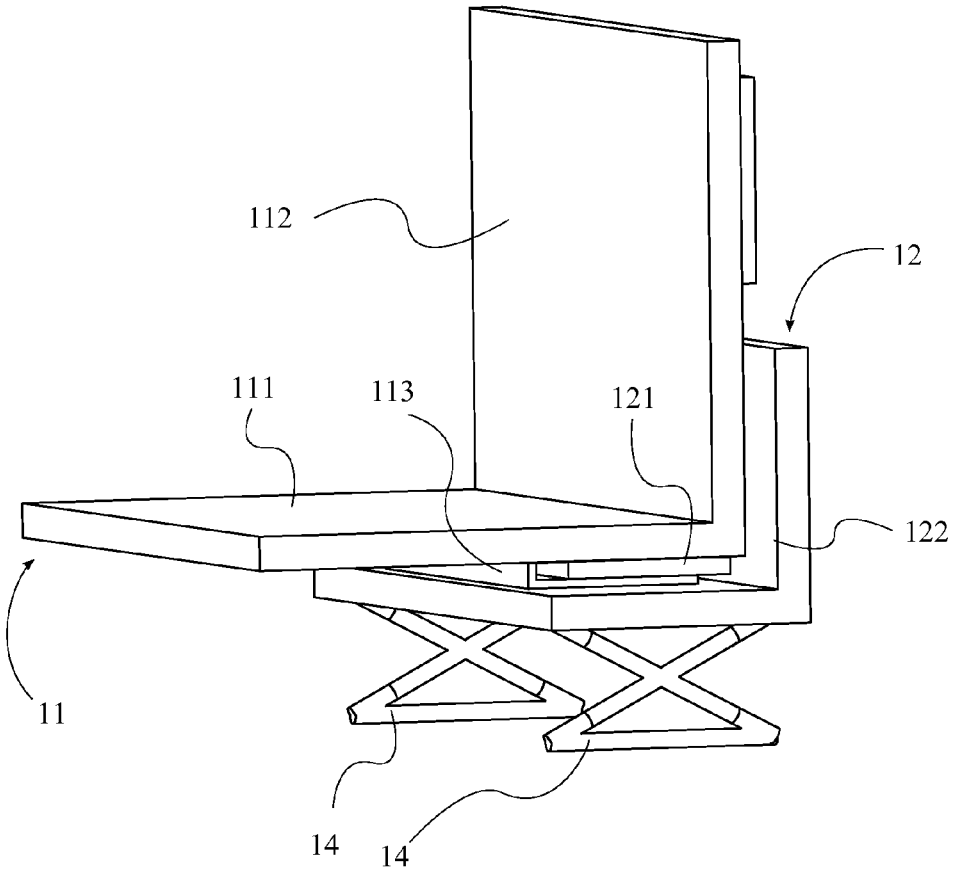
FIG. 5 is a side perspective view of the bathing chair.

The bathing chair 1 is made using a material, process or material/process combination that repels water, is safe for extended contact with human skin and water, and reduces the capability of bacteria or mold to grow. In the preferred embodiment of the present invention, the bathing chair 1 is made substantially of injection molded plastic, such as, but not limited to, polyethylene, high-density polyethylene, polyvinyl chloride, polypropylene, polyurethane, or another material or combination of materials, or another appropriate manufacturing process. Referring to FIG. 5, in the preferred embodiment, the bathing chair 1 comprises an upper chair portion 11 and a lower chair portion 12. It is assumed that a back wall is positioned adjacent to the bathtub 7 at a south end of the bathtub 7. As can be seen in FIG. 1, a north-south direction is defined along the longest direction of the bathtub 7 and may also be referred to as the longitudinal direction 8. The west-east direction is perpendicular to the north-south direction and may be referred to as the lateral direction 9.

The upper chair portion 11 comprises a seating surface 111 and a chair back 112, which are connected perpendicularly to each other. It is not required for the seating surface 111 and the chair back 112 to be at exactly 90 degrees to each other, only that a user is able to rest their back against the chair back 112 while seated on the seating surface 111 as is typical with chairs.

Figure 6:
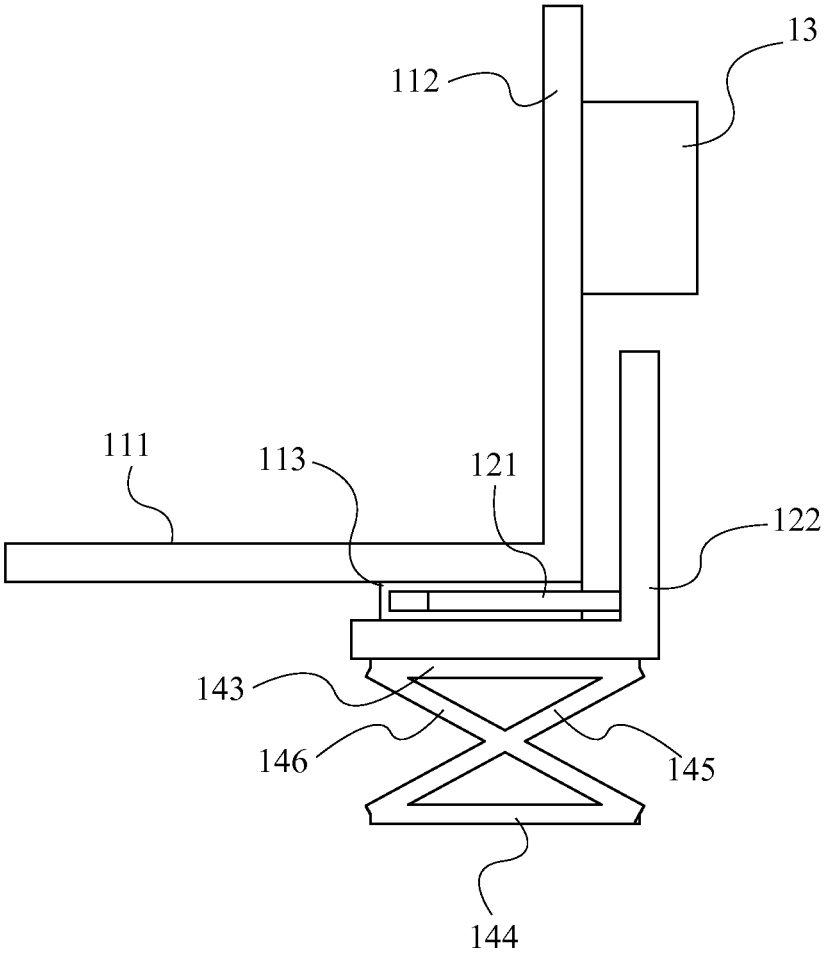
FIG. 6 is a side view of the bathing chair.
Figure 7:
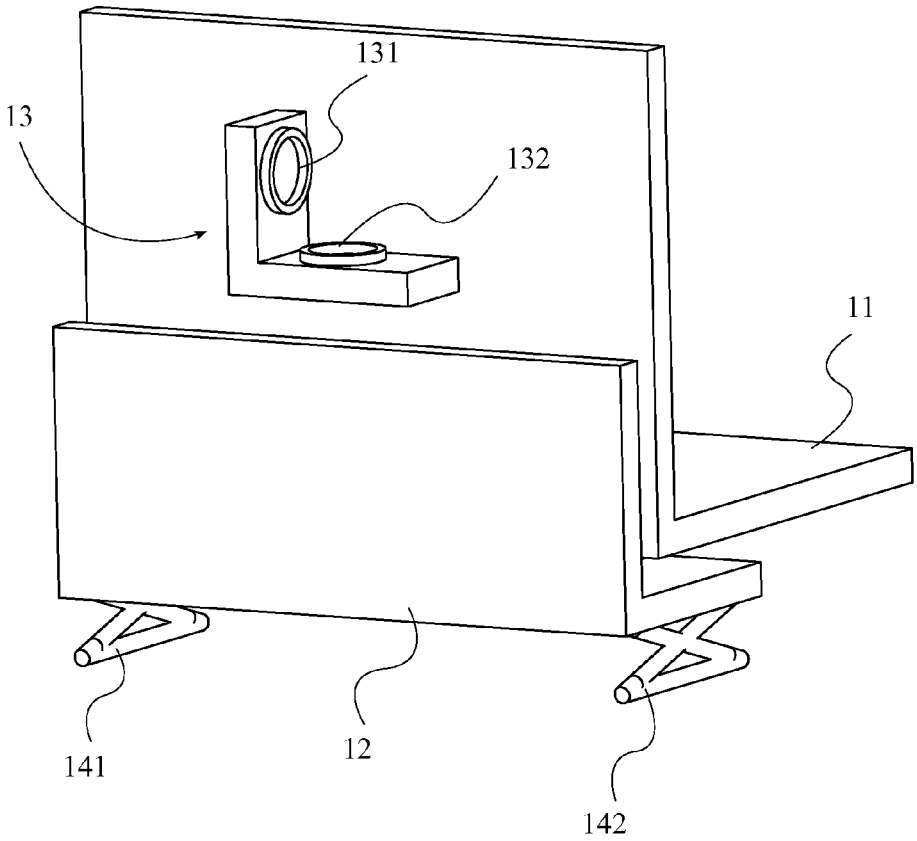
FIG. 7 is a back perspective view of the chair support board.

The upper chair portion 11 is removably attached atop the lower chair portion 12. As shown in FIGS. 5-7, in the preferred embodiment, this is accomplished through the means of a sheath 113 on the upper chair portion 11 and a flange 121 on the lower chair portion 12 that is removably attached within the sheath 113. The sheath 113 of the upper chair portion 11 is positioned on the underside of the upper chair portion 11 opposite the seating surface 111 of the upper chair portion 11. The flange 121 of the lower chair portion 12 is connected to and protrudes from a rear support 122 of the lower chair portion 12. The sheath 113 and the flange 121 are preferably both oriented horizontally, so that the flange 121 is inserted into the sheath 113 by moving the upper chair portion 11 and the lower chair portion 12 relatively towards each other horizontally.

Once the flange 121 is inserted within the sheath 113, they may be affixed to each other by a pin, screws, latches, snaps or another locking mechanism. This allows the upper chair portion 11 and the lower chair portion 12 to be disassembled from each other for maintenance or cleaning.

The bathing chair 1 further comprises a displacement arm connection 13. The displacement arm connection 13 is preferably connected to the chair back 112 of the upper chair portion 11 opposite the seating surface 111, though in alternate embodiments the displacement arm connection 13 may be positioned in any other convenient location on the bathing chair 1. In the preferred embodiment of the present invention, the displacement arm connection 13 comprises a lateral connection 131 and a vertical connection 132. The lateral connection 131 is oriented along the lateral direction 9, and the vertical connection 132 is oriented perpendicular to the lateral direction 9 and the longitudinal direction 8. The displacement arm connection 13 is not necessarily limited to the lateral connection 131 and the vertical connection 132, and it is contemplated that in alternate embodiments, the displacement arm connection 13 may comprise an alternate arrangement providing a connection for the chair displacement mechanism 2.

The lateral connection 131 allows the chair displacement mechanism 2 to grab the bathing chair 1 in order to displace the bathing chair 1 laterally from outside the bathtub 7 to inside the bathtub 7. The vertical connection 132 similarly allows the chair displacement mechanism 2 to grab the bathing chair 1 in order to raise or lower the bathing chair 1 vertically into or out of the bathtub 7. In the preferred embodiment, the lateral connection 131 and the vertical connection 132 are positioned at right angles to each other, with the lateral connection 131 facing east and the vertical connection 132 facing upwards.

In the preferred embodiment of the present invention, the bathing chair 1 further comprises a plurality of collapsible legs 14 that are connected to the lower chair portion 12 opposite the upper chair portion 11. The plurality of collapsible legs 14 preferably comprises a first collapsible leg 141 and a second collapsible leg 142, which are positioned opposite each other on the lower chair portion 12 along the lateral direction 9, one at each lateral (east-west) side of the bathing chair 1. The plurality of collapsible legs 14 are removably positioned atop the chair support board 3. More particularly, each of the plurality of collapsible legs 14 are positioned within one of a plurality of leg receptacles on the chair support board 3 when the bathing chair 1 is being supported by the chair support board 3. That is, when the bathing chair 1 is supported by the chair support board 3, the collapsible legs 14 are received by the leg receptacles (35, 36).

The plurality of collapsible legs 14 may use any arrangement in order to fulfill the function of being collapsible along the vertical direction. In the preferred embodiment, the first collapsible leg 141 and the second collapsible leg 142 each comprise a first horizontal bar 143, a second horizontal bar 144, a first cross bar 145 and a second cross bar 146. The first horizontal bar 143 and the second horizontal bar 144 are positioned vertically opposite each other, with the first cross bar 145 and the second cross bar 146 being attached between the first horizontal bar 143 and the second horizontal bar 144 in a criss-cross manner. Each of the collapsible legs 14 can collapse onto itself, with the first horizontal bar 143 and the second horizontal bar 144 being brought vertically closer to each other. The first horizontal bar 143 of each of the foldable leg mechanisms is attached to the bottom of the lower chair portion 12. It is contemplated that the collapsible legs 14 may be unnecessary and therefore not comprised in some embodiments of the present invention. Additionally, the collapsible legs 14 may be replaced by static legs, or a single leg, if deemed appropriate in alternate embodiments.

Figure 8:
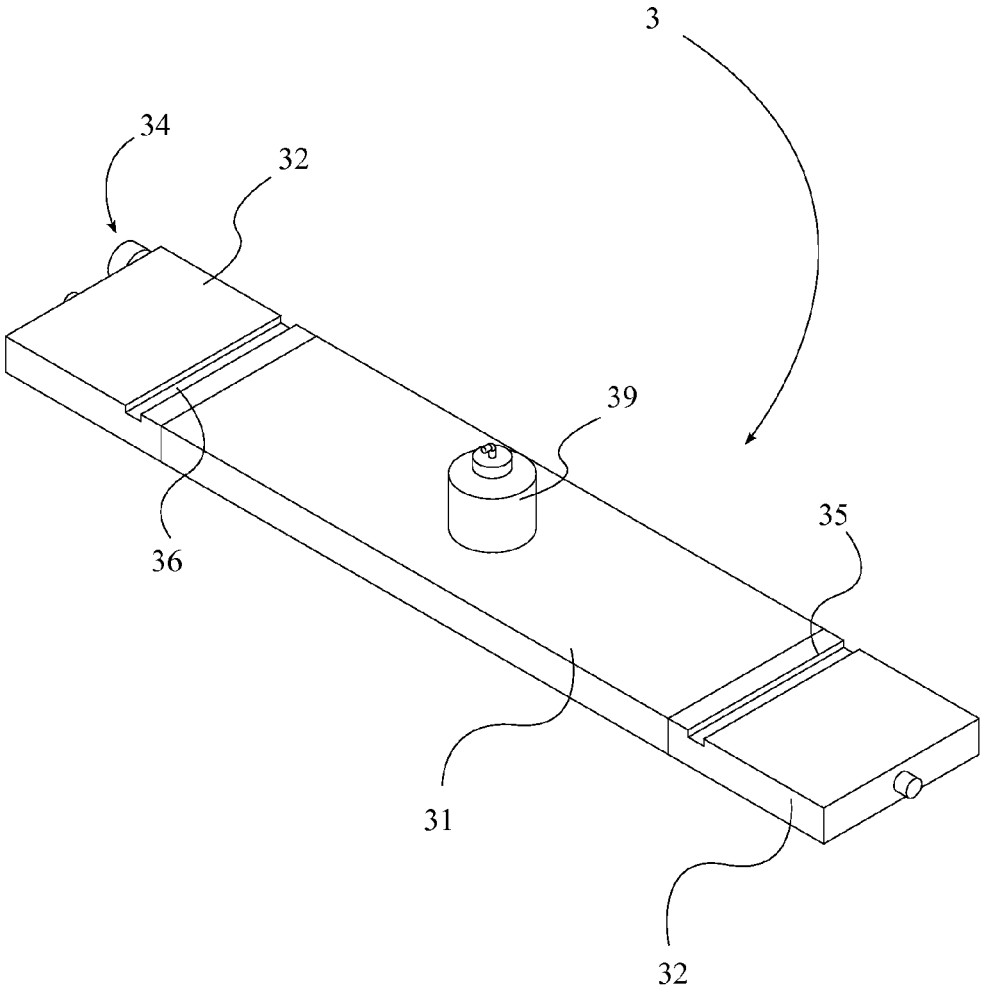
FIG. 8 is an elevated perspective view of the chair support board.
Figure 9:
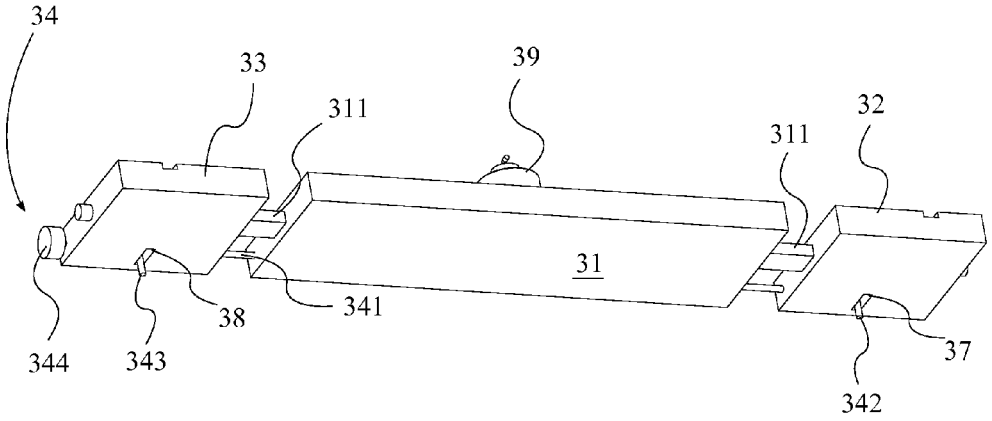
FIG. 9 is a lowered perspective view of the chair support board with the lateral board portions extended.

Referring to FIG. 8-9, in the preferred embodiment of the present invention, the chair support board 3 comprises a central board portion 31, a first lateral board portion 32 and a second lateral board. The central board portion 31 comprises two lateral protrusions 311 which are slidably connected within the two lateral board portions. This enables the chair support board 3 to be adjustable in width along the lateral direction 9 by being expandable away from the central board portion 31, if needed, to accommodate larger users. The first lateral board portion 32 and the second lateral board portion 33 are positioned opposite each other across the central board portion 31 and adjacent to the central board portion 31.

The chair support board 3 further comprises a first leg receptacle 35 and a second leg receptacle 36. The first leg receptacle 35 and the second leg receptacle 36 receive the first collapsible leg 141 and the second collapsible leg 142 when the bathing chair 1 is affixed to the chair support board 3. The first leg receptacle 35 and the second leg receptacle 36 are positioned opposite each other atop the chair support board 3. The first collapsible leg 141 is removably positioned within the first leg receptacle 35, and likewise the second collapsible leg 142 is removably positioned within the second leg receptacle 36. Preferably, the first leg receptacle 35 is positioned on the first lateral board portion 32, and the second leg receptacle 36 is positioned on the second lateral board portion 33, though this is not necessarily required.

The chair support board 3 also comprises a latch mechanism 34 which allows the user to affix the chair support board 3 in any desired location along the tub. The latch mechanism 34 preferably comprises a latch knob 344, which is connected adjacent to a latch rail 341 that traverses laterally through the two lateral board portions and the central board portion 31 of the chair support board 3. A first latch protrusion 342 and a second latch protrusion 343 are perpendicularly connected to the latch rail 341, are positioned within the chair support board 3 and are allowed to protrude downward from out of the chair support board 3 through a first latch aperture 37 and a second latch aperture 38, respectively. The first latch aperture 37 and the second latch aperture 38 are positioned opposite each other on the underside of the chair support board 3 opposite the first leg receptacle 35 and the second leg receptacle 36. Turning the latch knob 344 turns the latch protrusions, so that the first latch protrusion 342 and the second latch protrusion 343 are removably connected within one of a plurality of latch slots 10 on the first chair support rail 4 and the second chair support rail 5, respectively, in order to affix the chair support board 3 in a specific position along the length of the bathtub 7. The latch knob 344 is positioned adjacent to either the first lateral board portion 32 or the second lateral board portion 33 opposite the central board portion 31. Preferably, the first latch aperture 37 and the second latch aperture 38 are positioned on the first lateral board portion 32 and the second lateral board portion 33, respectively, though this is not necessarily required.

The chair support board 3 additionally comprises a chair raising mechanism 39. The chair raising mechanism 39 is preferably a hydraulic or pneumatic mechanism that allows the bathing chair 1 to be raised or lowered while connected to the chair support board 3. The chair raising mechanism 39 is centrally positioned atop the central board portion 31 of the chair support board 3, and is connected to the central board portion 31 of the chair support board 3. In the preferred embodiment of the present invention, the chair raising mechanism 39 is a telescoping tubular apparatus with an attached handle that allows the user to control the height of the bathing chair 1 with the chair raising mechanism 39. Additionally, the uppermost portion of the chair raising mechanism 39 has a latch or other type of connection hardware that allows the bottom chair portion of the bathing chair 1 to be connected to the chair raising mechanism 39 and thereby to the chair support board 3. The chair raising mechanism 39 is removably attached to the lower chair portion 12 opposite the flange 121 of the lower chair portion 12, wherein the chair raising mechanism 39 raises or lowers the bathing chair 1 while the bathing chair 1 is attached to the chair support board 3. It is contemplated that in some embodiments the chair raising mechanism 39 may be redundant with other components and not needed, for example if the collapsible legs 14 are powered/motorized.

Figure 12:
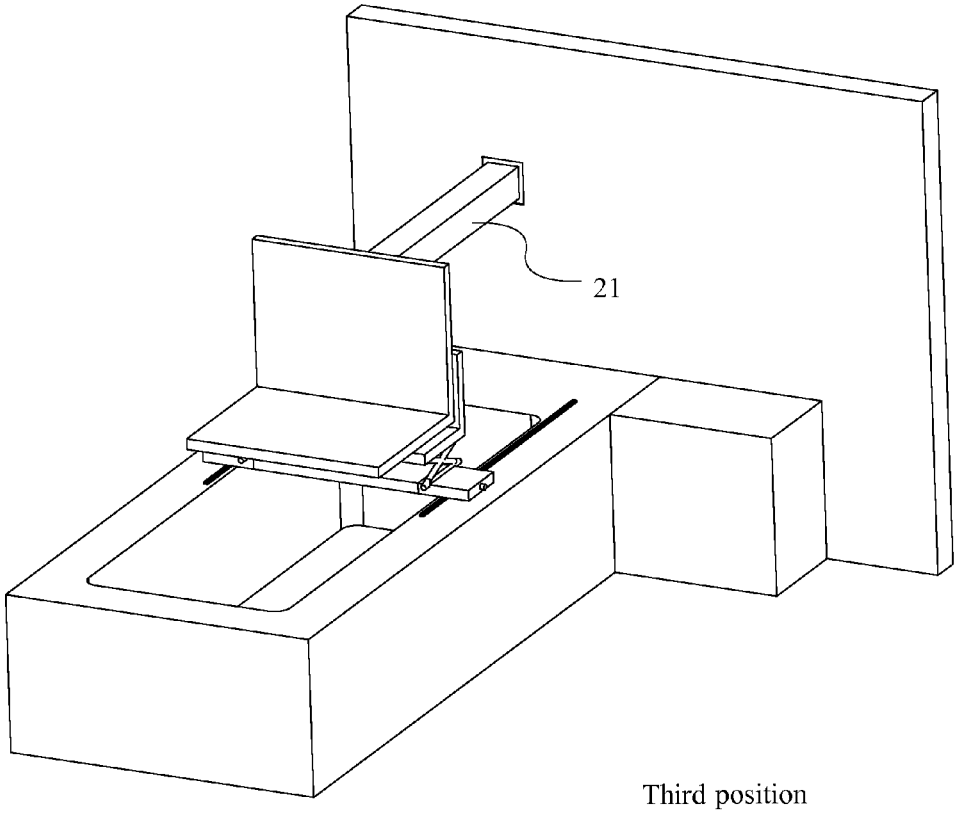
FIG. 12 is an elevated perspective view of the present invention in the third position.

Referring to FIG. 1, the first chair support rail 4 and the second chair support rail 5 are positioned laterally opposite each other across the bathtub 7, oriented parallel to each other, and connected atop the bathtub 7. The chair support board 3 slides longitudinally atop the first chair support rail 4 and the second chair support rail 5 from the southmost portion of the bathtub 7, preferably to about the halfway point of the length of the bathtub 7, as can be seen in FIG. 12. The first chair support rail 4 and the second chair support rail 5 each comprise a plurality of latch slots 10 into which the latch protrusions may be inserted in order to affix the chair support board 3 at one of the slot locations. In alternate embodiments, alternate means for affixing the bathing chair 1 at a desired position along the length of the bathtub 7 may be comprised, such as a ratcheting mechanism, for example.

In the preferred embodiment of the present invention, the chair displacement mechanism 2 is connected to a back wall of a bathroom adjacent to the bathtub 7, wherein the back wall is understood to be perpendicular to the longitudinal direction 8. The chair displacement mechanism 2 preferably comprises a longitudinal displacement arm 21 and a pivoting displacement arm 22. Referring to FIGS. 10-13, the longitudinal displacement arm 21 extends and retracts in the longitudinal direction 8 out from the back wall, and is the means for pushing and pulling the bathing chair 1 in the longitudinal direction 8, wherein the longitudinal displacement arm 21 is oriented perpendicular to the back wall along the longitudinal direction 8. The pivoting displacement arm 22 is perpendicularly connected to the end of the longitudinal displacement arm 21 opposite the back wall. The pivoting displacement arm 22 is able to extend and retract laterally from inside the bathtub 7 to outside the tub, preferably by a telescoping mechanism, and is able to rotate relative to the longitudinal displacement arm 21 in a plane defined by the lateral direction 9 and the vertical direction. The pivoting displacement arm 22 may be pivotally connected to the longitudinal displacement arm 21 in order to rotate, or the pivoting displacement arm 22 may be rotationally fixed to the longitudinal displacement arm 21 while the longitudinal displacement arm 21 rotates in order to rotated the pivoting displacement arm 22. Any mechanical components necessary to realize the aforementioned capability should preferably be stored within the back wall out of sight, but may be positioned in any location as appropriate.

The pivoting displacement arm 22 is removably attached to either the lateral connection 131 or the vertical connection 132 of the bathing chair 1, wherein the bathing chair 1 is displaced by the longitudinal displacement arm 21 extending or retracting along the longitudinal direction 8, or by the pivoting displacement arm 22 extending or retracting along the lateral direction 9, or by the pivoting displacement arm 22 extending or retracting along the vertical direction.

In the preferred embodiment of the present invention, the chair displacement mechanism 2 is made of a strong material capable of supporting several hundred pounds of weight, such as, but not limited to, hardened steel or another suitable material. The longitudinal displacement arm 21 must be firmly anchored within the back wall to support the weight of users. Additional supports for the displacement arm may be comprised, such as a support perpendicularly connected between the displacement arm and a side rail on a side wall perpendicular to the back wall which slides along the side rail with the longitudinal displacement arm 21. The longitudinal displacement arm 21 and the pivoting displacement arm 22 are preferably operated by means of hydraulic or pneumatic pumps, though any appropriate means for operating the longitudinal displacement arm 21 may be utilized, such as but not limited to electric motors. The chair displacement mechanism 2 is preferably activated and controlled by the user with an electronic remote control, although some aspects of the chair displacement mechanism 2 may be operated manually. For instance, the bathing chair 1 may be moved forward along the rails by means of a hand crank or wheel. Additionally, the latch mechanism 34 is preferably operated by hand by turning the latch knob 344, though an electric component may be added or substituted in order to operate the latch mechanism 34.

Figure 10:
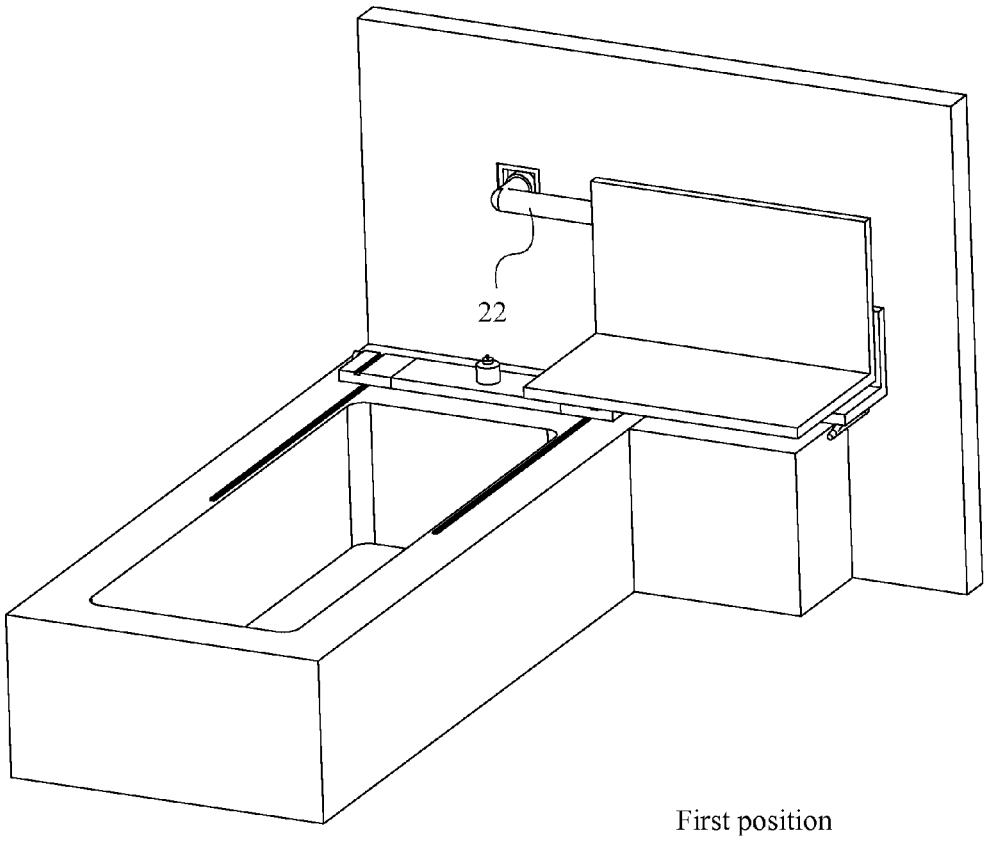
FIG. 10 is an elevated perspective view of the present invention in the first position.
Figure 11:
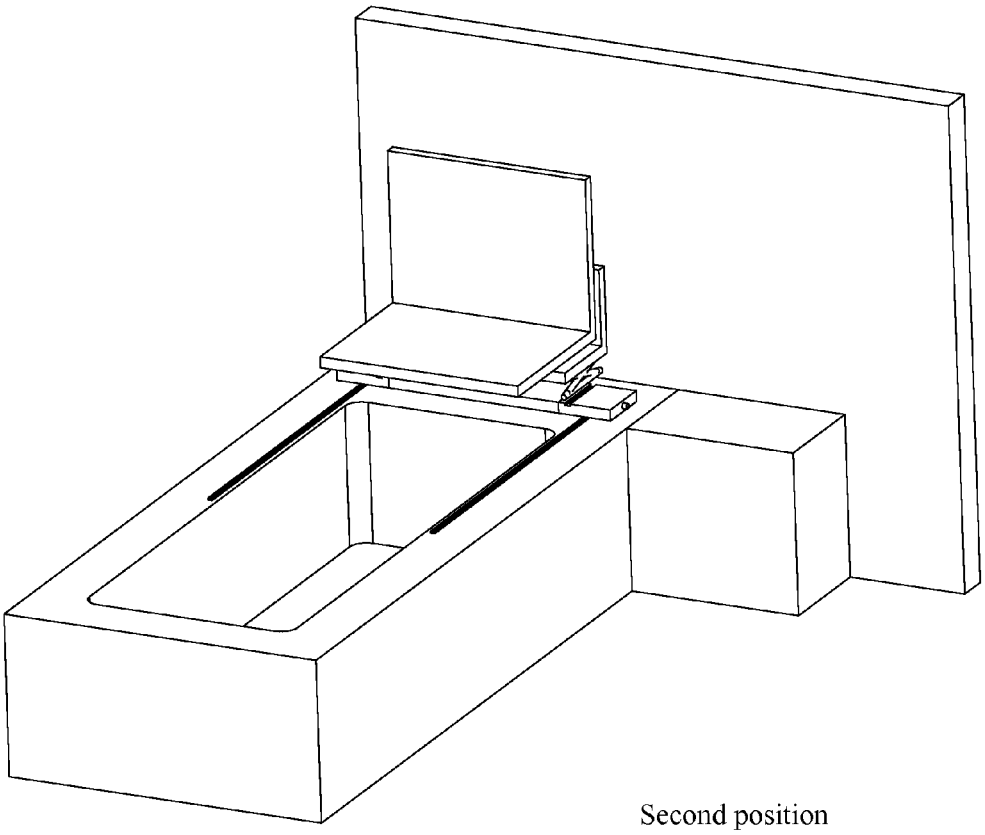
FIG. 11 is an elevated perspective view of the present invention in the second position.

Referring to FIGS. 10-11, the chair displacement mechanism 2 is able to pull the bathing chair 1 from a first position outside the bathtub 7 to a second position inside the bathtub 7, and subsequently to a third position or a fourth position inside the bathtub 7. The first position is outside the bathtub 7, at the south end of the bathtub 7 adjacent to the back wall. In this position, the pivoting displacement arm 22 is connected to the lateral displacement arm connection 13 on the bathing chair 1. To pull the bathing chair 1 into the second position, the pivoting displacement arm 22 retracts by telescoping into itself. Once the bathing chair 1 is in the second position and the pivoting displacement arm 22 is fully retracted, the pivoting displacement arm 22 is disconnected from the lateral displacement arm connection 13, swivels 90 degrees to a downward facing orientation, and is then connected to the vertical displacement arm connection 13 on the bathing chair 1. The pivoting displacement arm 22 may be connected to the displacement arm connection 13 by any appropriate means, such as but not limited to a latch, clamp, screw threads, or other means. All the functions of the chair displacement mechanism 2 should be controlled electronically via remote control. The chair displacement mechanism 2 is preferably battery operated, though the chair displacement mechanism 2 may draw power from another source if needed.

The user then chooses whether to take a bath or a shower. If the user wishes to take a shower, the user connects the bathing chair 1 to the chair raising mechanism 39, and slides forward in the tub along with the chair support board 3 with the help of the longitudinal displacement arm 21, which extends forward, pushing the bathing chair 1 forward. The user selects a desired location along the rails and secures the bathing chair 1 in place with the latch mechanism 34. The user may then operate the chair raising mechanism 39 to raise the chair to a desired position for taking a shower. This is the third position, as can be seen in FIG. 12. To return to the first position, the process is simply repeated in reverse.

Figure 13:
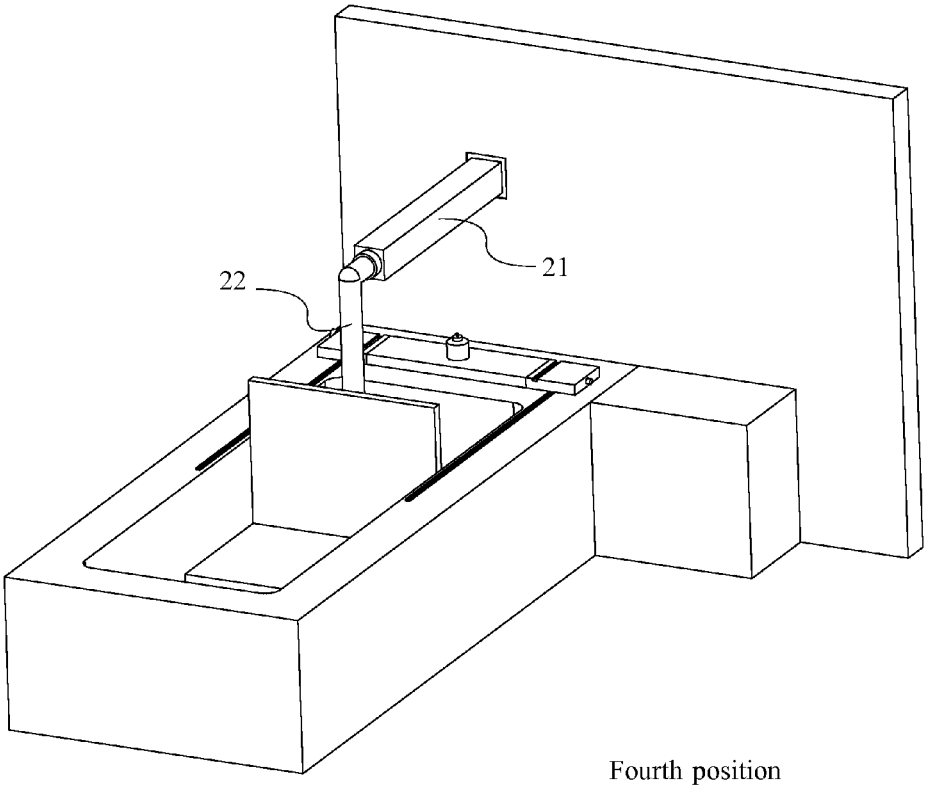
FIG. 13 is an elevated perspective view of the present invention in the fourth position.

If the user wishes to take a bath, the user does not connect the bathing chair 1 to the chair support board 3. Instead, the longitudinal displacement arm 21 pushes the bathing chair 1 forward, and then the pivoting displacement arm 22, which is connected to the vertical displacement arm connection 13 on the bathing chair 1, extends, displacing the bathing chair 1 downward into the bathtub 7 so that the user may submerge part of their body under bath water. This is the fourth position, as can be seen in FIG. 13. To return to the first position, the process is simply repeated in reverse.

In the preferred embodiment, additional safety features are incorporated to guard against slipping or breakage of the present invention. One such safety feature is a stationary support outside the bathtub 7 where the chair is in the first position that supports the weight of the chair while a user is loading themselves into the chair. An additional safety feature that may be incorporated is a plurality of horizontal tracks installed on the back wall. A support may be connected to the bathing chair 1 and also to a plurality of rails within the plurality of tracks, adding structural support to the present invention, and peace of mind for the user.

Although the invention has been explained in relation to its preferred embodiment, it is to be understood that many other possible modifications and variations can be made without departing from the spirit and scope of the invention as herein described.

What is claimed is:

1. A sliding chair for assisting entering and exiting a bathtub comprises:

a bathing chair;

a chair displacement mechanism;

a chair support board;

a first chair support rail and a second chair support rail;

the chair displacement mechanism being positioned adjacent to a bathtub;

the bathing chair being operatively connected to the chair displacement mechanism, wherein the chair displacement mechanism is capable of displacing the bathing chair along both a longitudinal direction and a lateral direction for the bathtub;

wherein the longitudinal direction and the lateral direction are oriented perpendicular to each other;

the bathing chair being removably connected atop the chair support board;

the chair support board being slidably connected to the first chair support rail and a second chair support rail;

the first chair support rail and a second chair support rail being oriented along the longitudinal direction;

the bathing chair comprises an upper chair portion and a lower chair portion; and the upper chair portion being removably attached atop the lower chair portion.

2. The sliding chair for assisting entering and exiting a bathtub as claimed in claim 1 comprises:

the upper chair portion comprises a sheath;

the lower chair portion comprises a flange;

the sheath being positioned on the underside of the upper chair portion opposite a seating surface of the upper chair portion;

the flange being connected to a rear support of the lower chair portion; and the flange being removably connected within the sheath.

3. The sliding chair for assisting entering and exiting a bathtub as claimed in claim 2 comprises:

the sheath and the flange both being oriented horizontally, wherein the flange is inserted into the sheath by moving the upper chair portion and the lower chair portion horizontally towards each other.

4. The sliding chair for assisting entering and exiting a bathtub as claimed in claim 1 comprises:

the upper chair portion comprises a seating surface and a chair back; and the seating surface and the chair back being connected perpendicularly to each other.

5. The sliding chair for assisting entering and exiting a bathtub as claimed in claim 1 comprises:

the bathing chair further comprises a displacement arm connection.

6. The sliding chair for assisting entering and exiting a bathtub as claimed in claim 5 comprises:

the displacement arm connection being connected to a chair back of the upper chair portion opposite the seating surface.

7. The sliding chair for assisting entering and exiting a bathtub as claimed in claim 5 comprises:

the displacement arm connection comprises a lateral connection and a vertical connection;

the lateral connection being oriented along the lateral direction, wherein a pivoting displacement arm of the chair displacement mechanism traverses along the lateral direction while connected to the lateral connection in order to displace the bathing chair along the lateral direction; and the vertical connection being oriented perpendicular to the lateral direction and the longitudinal direction.

8. The sliding chair for assisting entering and exiting a bathtub as claimed in claim 1 comprises:

the first chair support rail and the second chair support rail being oriented parallel to each other;

the first chair support rail and the second chair support rail being connected atop the bathtub; and the first chair support rail and the second chair support rail being positioned laterally opposite each other across the bathtub.

9. The sliding chair for assisting entering and exiting a bathtub as claimed in claim 1 comprises:

the bathing chair further comprises a plurality of collapsible legs; and the plurality of collapsible legs being connected to the lower chair portion opposite the upper chair portion.

10. The sliding chair for assisting entering and exiting a bathtub as claimed in claim 9 comprises:

the plurality of collapsible legs being removably positioned atop the chair support board.

11. The sliding chair for assisting entering and exiting a bathtub as claimed in claim 9 comprises:

the plurality of collapsible legs comprises a first collapsible leg and a second collapsible leg;

the first collapsible leg and the second collapsible leg being positioned opposite each other on the lower chair portion along the lateral direction;

the first collapsible leg being removably positioned within a first leg receptacle from the plurality of leg receptacles; and the second collapsible leg being removably positioned within a second leg receptacle from the plurality of leg receptacles.

12. The sliding chair for assisting entering and exiting a bathtub as claimed in claim 1 comprises:

the chair displacement mechanism comprises a longitudinal displacement arm and a pivoting displacement arm; and the pivoting displacement arm being perpendicularly connected to the longitudinal displacement arm.

13. The sliding chair for assisting entering and exiting a bathtub as claimed in claim 12 comprises:

the pivoting displacement arm being pivotally connected to the longitudinal displacement arm, wherein the pivoting displacement arm is able to rotate within a plane defined by the lateral direction and the vertical direction.

14. The sliding chair for assisting entering and exiting a bathtub as claimed in claim 12 comprises:

the pivoting displacement arm being removably attached to either a lateral connection or a vertical connection of the bathing chair, wherein the bathing chair is displaced by the longitudinal displacement arm extending or retracting along the longitudinal direction, or by the pivoting displacement arm extending or retracting along the lateral direction, or by the pivoting displacement arm extending or retracting along the vertical direction.

15. The sliding chair for assisting entering and exiting a bathtub as claimed in claim 12 comprises:

the longitudinal displacement arm being oriented perpendicular to the back wall along the longitudinal direction.

16. The sliding chair for assisting entering and exiting a bathtub as claimed in claim 1 comprises:

the chair displacement mechanism being connected to a back wall adjacent to the bathtub, wherein the back wall is perpendicular to the longitudinal direction; and a pivoting displacement arm of the chair displacement mechanism being positioned opposite the back wall along a longitudinal displacement arm of the chair displacement mechanism.

17. The sliding chair for assisting entering and exiting a bathtub as claimed in claim 1 comprises:

the chair support board being adjustable in width along the lateral direction.

18. The sliding chair for assisting entering and exiting a bathtub as claimed in claim 17 comprises:

the chair support board comprises a central board portion, a first lateral board portion, and a second lateral board portion;

the first lateral board portion and the second lateral board portion being positioned adjacent to the central board portion and opposite each other across the central board portion; and the first lateral board portion and the second lateral board portion each being laterally expandable away from the central board portion.

19. The sliding chair for assisting entering and exiting a bathtub as claimed in claim 1 comprises:

the chair support board comprises a latch mechanism, a first leg receptacle, a second leg receptacle, a first latch aperture, and a second latch aperture;

the latch mechanism comprises a latch knob, a first latch protrusion and a second latch protrusion;

the latch knob being positioned adjacent to either the first lateral board portion or the second lateral board portion opposite the central board portion;

the latch rail traversing laterally through the chair support board;

the first leg receptacle and the second leg receptacle being positioned opposite each other atop the chair support board;

the first latch aperture and the second latch aperture being positioned opposite each other on the underside of the chair support board opposite the first leg receptacle and the second leg receptacle;

the first latch protrusion being positioned within the first latch aperture;

the second latch protrusion being positioned within the second latch aperture; and the first latch protrusion and the second latch protrusion being removably connected within one of a plurality of latch slots of the first chair support rail and the second chair support rail, respectively, by turning the latch knob.

20. The sliding chair for assisting entering and exiting a bathtub as claimed in claim 1 comprises:

a chair raising mechanism being centrally positioned atop the chair support board; and the chair raising mechanism being removably attached to the lower chair portion opposite a flange of the lower chair portion, wherein the chair raising mechanism raises or lowers the bathing chair while the bathing chair is attached to the chair support board.

* * * * *